US007448215B2

(12) United States Patent
Macquisten et al.

(10) Patent No.: US 7,448,215 B2
(45) Date of Patent: Nov. 11, 2008

(54) COMBUSTION CHAMBER FOR A GAS TURBINE ENGINE

(75) Inventors: Michael A Macquisten, Derby (GB); Anthony J Moran, Nuneaton (GB); Michael Whiteman, Loughborough (GB); Jonathan F Carrotte, Leicester (GB); Ashley G Barker, Loughborough (GB); Martin S Goodwin, Loughborough (GB)

(73) Assignee: Rolls-Royce plc, London (GB)

( * ) Notice: Subject to any disclaimer, the term of this patent is extended or adjusted under 35 U.S.C. 154(b) by 548 days.

(21) Appl. No.: 11/280,429

(22) Filed: Nov. 17, 2005

(65) Prior Publication Data

US 2006/0123791 A1 Jun. 15, 2006

(30) Foreign Application Priority Data

Dec. 11, 2004 (GB) ..... 0427147.4

(51) Int. Cl.
*F02C 7/24* (2006.01)

(52) U.S. Cl. ..... 60/725; 60/39.83; 431/114; 181/220

(58) Field of Classification Search ..... 60/39.83, 60/725, 752; 181/213, 219, 220, 222; 431/114
See application file for complete search history.

(56) References Cited

U.S. PATENT DOCUMENTS

| | | | | |
|---|---|---|---|---|
| 5,644,918 | A | 7/1997 | Gulati | |
| 6,546,729 | B2 * | 4/2003 | Hellat et al. | 60/725 |
| 2004/0211185 | A1 * | 10/2004 | Young et al. | 60/725 |

FOREIGN PATENT DOCUMENTS

| | | | |
|---|---|---|---|
| EP | 1 424 006 | A | 6/2004 |
| EP | 1 434 006 | A | 6/2004 |
| GB | 2 288 660 | A | 10/1995 |
| GB | 2 396 687 | A | 6/2004 |

* cited by examiner

*Primary Examiner*—Louis J Casaregola
(74) *Attorney, Agent, or Firm*—W. Warren Taltavull; Manelli Denison & Selter PLLC

(57) ABSTRACT

A combustion chamber suitable for a gas turbine engine is provided with at least one Helmholtz resonator having a resonator cavity and a resonator neck in flow communication with the chamber interior. The resonator neck is provided with at least cooling holes extending through its wall for improved damping and cooling, at least one of the holes is directed towards the resonator cavity.

13 Claims, 4 Drawing Sheets

COMBUSTION CHAMBER FOR A GAS TURBINE ENGINE

This invention relates to combustion chambers for gas turbine engines, and in particular lean burn, low emission combustion chambers having one or more resonator chambers for damping pressure fluctuations in the combustion chamber in use.

Lean burn, low emission gas turbine engine combustors of the type now being developed for future engine applications have a tendency, under certain operating conditions, to produce audible pressure fluctuations which can cause premature structural damage to the combustion chamber and other parts of the engine. These pressure fluctuations are audible as rumble which occurs as a result of the combustion process.

Pressure oscillations in gas turbine engine combustors can be damped by using damping devices such as Helmholtz resonators, preferably in flow communication with the interior of the combustion chamber or the gas flow region surrounding the combustion chamber.

The use of Helmholtz resonators has been proposed in a number of earlier published patents including for example U.S. Pat. No. 5,644,918 where a plurality of resonators are connected to the head end, that is to say the upstream end, of the flame tubes of an industrial gas turbine engine combustor. This type of arrangement is particularly suitable for industrial gas turbine engines where there is sufficient space at the head of the combustor to install such damping devices. The combustor in a ground based engine application can be made sufficiently strong to support the resonators and the vibration loads generated by the resonators in use. This arrangement is not practicable for use in aero engine applications where space, particularly in the axial direction of the engine, is more limited and component weight is a significant design consideration.

A different approach to combustion chamber damping is therefore required for aero engine applications where space is more limited and design constraints require that the resonators are supported with respect to the combustion chamber without adding appreciably to the weight of the combustion chamber itself.

One form of Helmholtz resonator that is particularly suitable for a combustion chamber for aero engine applications is described in EP 1,424,006A2. The arrangement provides at least one Helmholtz resonator having a resonator cavity and a neck in flow communication with the interior of the combustion chamber, the neck having at least one cooling hole extending through the wall thereof. The cooling hole directs a film of cooling air on the inner surface of the tube wall in the region of the combustor opening, the film protecting the tube from the effects of the high temperature combustion gasses entering and exiting the resonator neck during unstable combustor operations.

It has now been found that at certain operating conditions the resonator body can overheat despite the presence of a cooling flow through holes in the neck of the resonator. Whilst not wishing to be bound to the theory it is believed that holes angled towards the combustion chamber can induce a vortex of air within the neck that extends into the combustion chamber. The vortex sucks hot combustion gasses deep into the neck and even into the resonator body.

It is an object of the present invention to seek to provide an improved damper arrangement for a combustion chamber.

According to an aspect of the present invention there is provided a combustion chamber for a gas turbine engine comprising at least one Helmholtz resonator having a resonator cavity and a resonator neck in flow communication with the interior of the combustion chamber, the neck having cooling holes extending through the wall thereof, at least one of the cooling holes having an axis that is directed towards the resonator cavity such that in use the cooling holes direct cooling air into the resonator cavity.

The above arrangement provides cooling air directed at, or towards the resonator cavity. The direction of air can prevent overheating of both the resonator neck and the cavity. The arrangement resists the ingestion of hot combustor gasses into the resonator cavity. It is to be understood that the term "cooling hole" used herein refers to any type of aperture through which cooling air or other fluid can pass.

In preferred embodiments, a plurality of cooling holes is provided in the wall of the tube. In this way it is possible to more uniformly cool the interior surface of the neck and the resonator cavity. Preferably the holes are circumferentially spaced in one or more rows extending around the circumference of the tube.

The cooling holes which have axis directed towards the resonator cavity are preferably positioned towards the cavity end of the neck and even more preferably, if the axis is extended, the axis will extend into the cavity itself.

By circumferentially spacing the cooling holes in rows it is possible to generate a film of cooling air on the interior surface of the resonator neck.

Preferably at least two circumferentially extending rows of holes are provided, spaced along the axis of the resonator neck. By having two or more rows of holes greater cooling efficiency and/or damping efficiency can be achieved. In preferred embodiments, the holes of the or each row are angled with respect to the longitudinal axis of the tube. This can prevent separation of the cooling air passing through the holes from the interior surface of the tube in the region of the holes. This arrangement also promotes flow of cooling air in the longitudinal direction of the tube.

Preferably, holes in a row of holes closer to the combustion chamber end of the neck are angled in a direction towards the combustion chamber end of the tube such that the respective axis of the holes converge in the direction of the combustion chamber. In this way the air generates a film between the holes and the end of the tube in the region of the combustion chamber opening. Angling the holes towards the combustion chamber improves the damping efficiency of the resonator.

Preferably, holes angled towards the resonator chamber are located towards the resonator chamber end of the tube. These holes direct air into the resonator chamber thereby generating a resonator chamber cooling flow and simultaneously a flow of cooling air that resists a counter flow of hot combustion gasses that may be generated by a row of holes angled towards the combustor.

Preferably the angle of the holes with respect to the longitudinal axis is in the region of 15-40 degrees. This promotes the generation of a cooling film on the interior surface of the wall and can avoid flow separation of the air entering the tube through the cooling holes. In one embodiment the angle of the holes with respect to the longitudinal axis is between around 15 to 30 degrees.

In preferred embodiments, the holes are additionally angled with respect to the tube circumference, that is to say with respect to a line tangential to the tube at the positions of the respective holes on the tube circumference. In this way it is possible to induce a vortex flow of cooling air on the interior surface of the tube as the cooling air passes into the combustion chamber or resonator body. This is particularly beneficial in terms of cooling the interior surface of the tube.

In preferred embodiments the holes have a tangential component substantially in the range of 5-60 degrees with respect to the tube circumference. By angling the holes with respect to the tube circumference by this amount it is possible to generate a steady vortex flow on the interior surface of the tube. In a preferred embodiment the angle of the holes with respect to the tube circumference is in the range of 10-50 degrees with respect to the tube circumference. Each of the rows may have holes at different angles with respect to the tube circumference to enable the generation of a different swirl. It is preferred for the holes closer to the combustion chamber to have a lower angle, preferably between 5 and 25 degrees, to keep the flow against the wall and thereby providing better damping functionality. The holes closer to the resonator cavity preferably have a greater angle, possibly between 20 and 50 degrees to provide greater purging of the resonator cavity.

The holes in the resonator neck closest to the combustion chamber are preferably configured for optimum damping. The holes in the resonator neck closest to the resonator chamber are preferably configured for optimum cooling of the resonator chamber and/or resonator neck.

In a preferred embodiment the flow of air through the holes configured for optimum damping is metered, the velocity and volume of the air selected to create a shedding vortex within the combustor.

According to another aspect of the invention there is provided a Helmholtz resonator for a gas turbine engine combustion chamber; the said resonator having a resonator cavity and a resonator neck for flow communication with the interior of the combustion chamber, the neck having cooling holes extending through the wall thereof, at least one of the cooling holes having an axis that is directed towards the resonator cavity such that in use the cooling holes direct cooling air into the resonator cavity. The invention contemplates a Helmholtz resonator in which the resonator neck comprises at least one cooling hole and also a combustion chamber including such a resonator.

For the avoidance of doubt the term "combustion chamber" used herein is used interchangeably with the term "combustor" and reference to one include reference to the other.

Various embodiments of the invention will now be more particularly described, by way of example only, with reference to the accompanying drawings in which.

Figure 1:
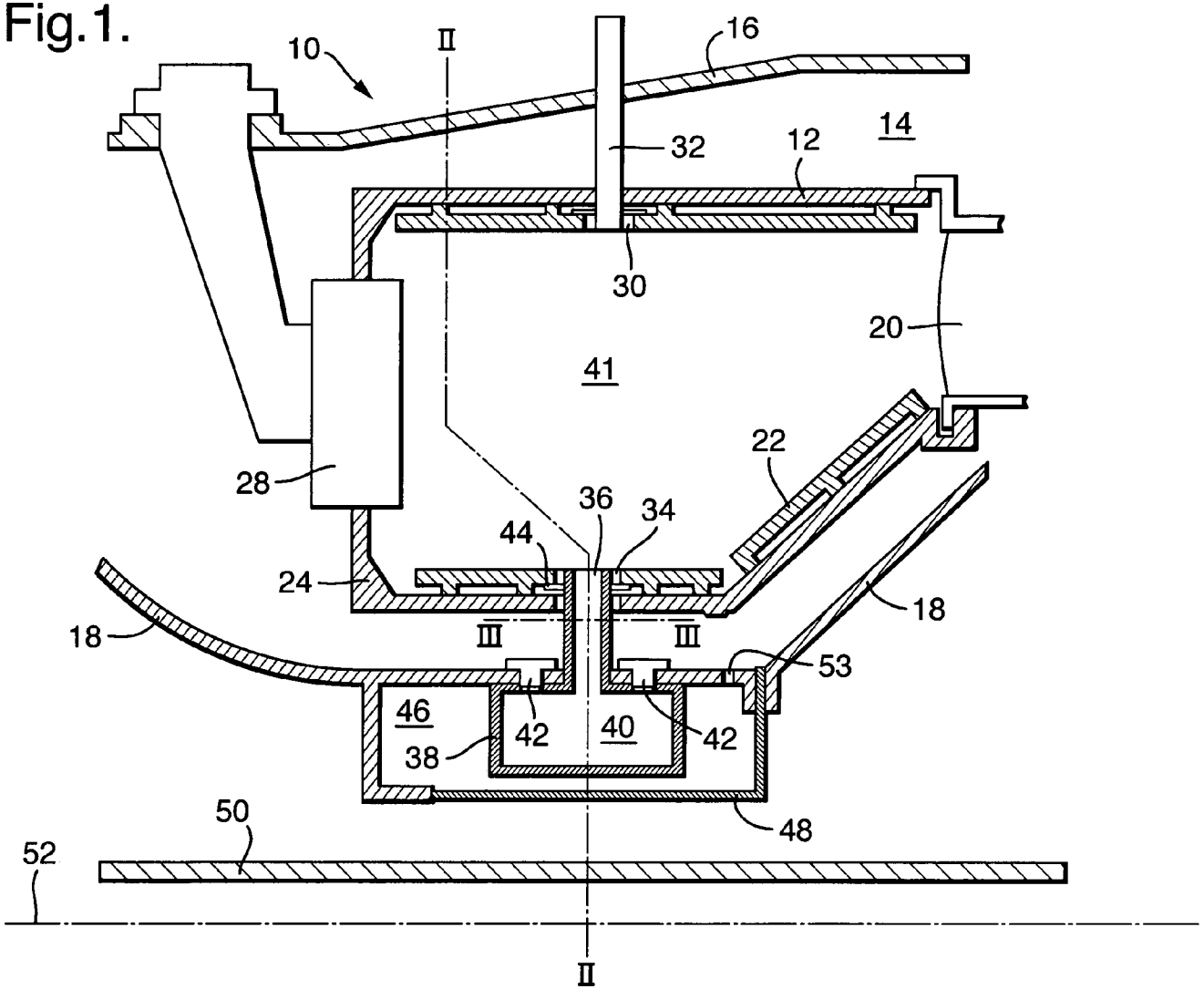
FIG. 1 is an axisymmetric view of a gas turbine engine combustion chamber showing a Helmholtz resonator in flow communication with the interior of the chamber.

Referring to FIG. 1, the combustion section 10 of a gas turbine aero engine is illustrated with the adjacent engine parts omitted for clarity, that is the compressor section upstream of the combustor (to the left of the drawing in FIG. 1) and the turbine section downstream of the combustion section. The combustion section comprises an annular type combustion chamber 12 positioned in an annular region 14 between a combustion chamber outer casing 16, which is part of the engine casing structure and radially outwards of the combustion chamber, and a combustion chamber inner casing 18, also part of the engine structure and positioned radially inwards of the combustion chamber 12. The inner casing 16 and outer casing 18 comprise part of the engine casing load bearing structure and the function of these components is well understood by those skilled in the art. The combustion chamber 12 is cantilevered at its downstream end from an annular array of nozzle guide vanes 20, one of which is shown in part in the drawing of FIG. 1. In this arrangement the combustion chamber may be considered to be a non load bearing component in the sense that it does not support any loads other than the loads acting upon it due to the pressure differential across the walls of the combustion chamber.

The combustion chamber comprises a continuous heat shield type lining on its radially inner and outer interior surfaces. The lining comprises a series of heat resistant tiles 22 which are attached to the interior surface of the radially inner and outer walls of the combustor in a known manner. The upstream end of the combustion chamber comprises an annular end wall 24 which includes a series of circumferentially spaced apertures 26 for receiving respective air fuel injection devices 28. The radially outer wall of the combustion chamber includes at least one opening 30 for receiving the end of an ignitor 32 which passes through a corresponding aperture in the outer casing 16 on which it is secured.

The radially inner wall of the combustion chamber is provided with a plurality of circumferentially spaced apertures 34 for receiving the end part of a Helmholtz resonator resonator neck 36. Each Helmholtz resonator 38 comprises a box like resonator cavity 40 which is in flow communication with the interior of the combustion chamber through the resonator neck 36 which extends radially from the resonator cavity 40 into the interior 41 of the combustor. In the drawing of FIG. 1 the resonator cavity 40 extends circumferentially around part of the circumference of the combustion chamber inner casing 18 on the radially inner side thereof. The resonator neck 36 extends through a respective aperture in the inner casing 18 in register with the aperture 34 in the combustion chamber inner wall. In this embodiment the resonator neck has a substantially circular cross section although tubes having cross sections other than circular may be used. The Helmholtz resonator 38 is fixed to the inner casing 18 by fixing means 42 in the form of bolts, studs or the like. The resonator 38 is therefore mounted and supported independently of the combustion chamber 12. An annular sealing member 44 is provided around the outer periphery of the tube to provide a gas tight seal between the tube and the opening 34. The tube provides for limited relative axial movement of the tube with respect to the combustion chamber so that substantially no load is transferred from the resonator tube to the combustion chamber during engine operation.

Figure 2:
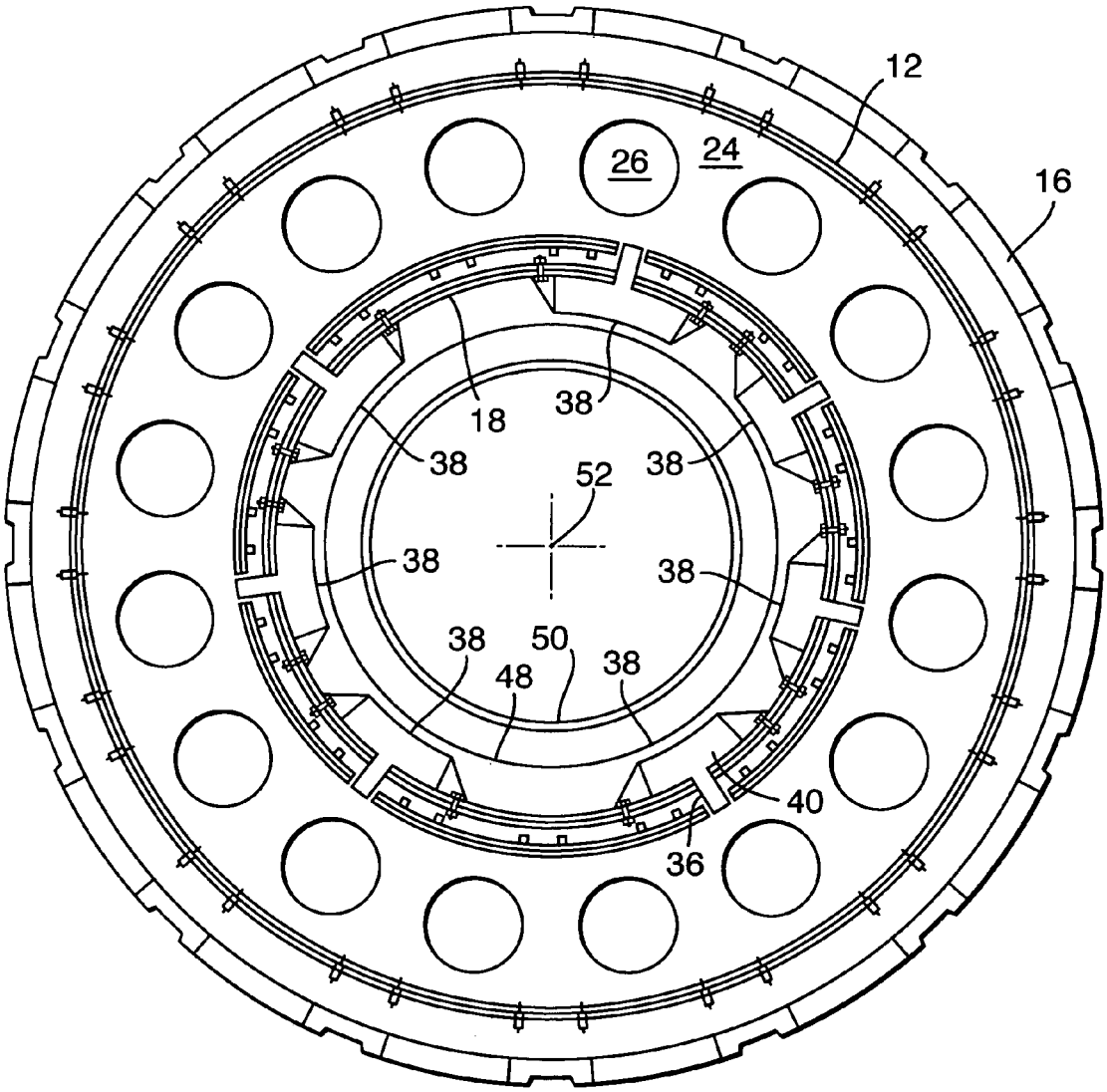
FIG. 2 is a cross sectional view of the gas turbine engine combustion section shown in FIG. 1 along the line II-II.

As can best be seen in the cross section drawing of FIG. 2, seven resonators 38 are positioned around the radially inner side of the combustion chamber inner casing 18. The resonators are arranged in two groups one including four resonators and the other group including the other three. The resonators have different circumferential dimensions such that the volume of the respective cavities 40 of the resonators is different for each resonator. This difference in cavity volume has the effect of ensuring each resonator has a different resonator frequency such that the respective resonators 38 compliment one another in the sense that collectively the resonators operate over a wide frequency band to damp pressure oscillations in the combustion chamber over substantially the entire running range of the engine. Each resonator has a particularly frequency and the resonator cavities 40 are sized such that the different resonator frequencies do not substantially overlap.

The axial location of the resonators can be different, as can the circumferential spacing between adjacent resonators.

The resonator cavities are enclosed in an annular cavity 46 defined on one side by the combustion chamber inner casing 18 and along the other side by a windage shield 48, which, in use, functions to reduce windage losses between the box type resonators 38 and the high pressure engine shaft 50 when it rotates about the engine axis 52. The windage shield 48 extends annularly around the inner casing 18 to enclose all seven resonators 38 in a streamlined manner so that windage losses are not generated by the close proximity of the resonator cavities to the engine shaft 50. A further function of the windage shield 48 is that it provides a containment structure in the event of mechanical failure of any one of the resonators 38. In the event of a mechanical failure resulting in the loss of structural integrity of a resonator, or other engine components, the windage shield acts to prevent the occurrence of secondary damage to the engine by contact with the engine shaft 50. Apertures 53 are provided in the combustion chamber inner casing 18 to allow flow communication between the annular region 14, and the annular cavity 46 defined by the windage shield 48 and the combustion chamber inner casing 18. This ensures that, during engine operation, the enclosed volume 46 of the windage shield is at the same pressure as the annular region 14 surrounding the combustion chamber, which is at higher pressure than the combustion chamber interior 41. The resultant pressure difference guarantees that, in the event of mechanical failure of any one of the resonators, air flows air into the combustion chamber 12 from the enclosed volume 46, preventing the escape of hot exhaust gasses that would severely hazard, for example, the engine shaft 50.

Figure 3:
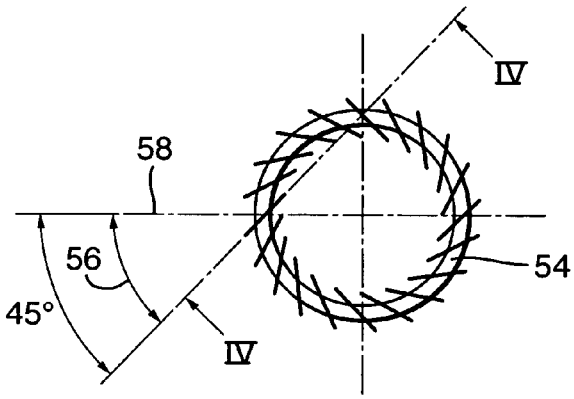
FIG. 3 is a cross section view of the resonator neck of the resonator along the lines III-III in the drawing of FIG. 1.
Figure 4:
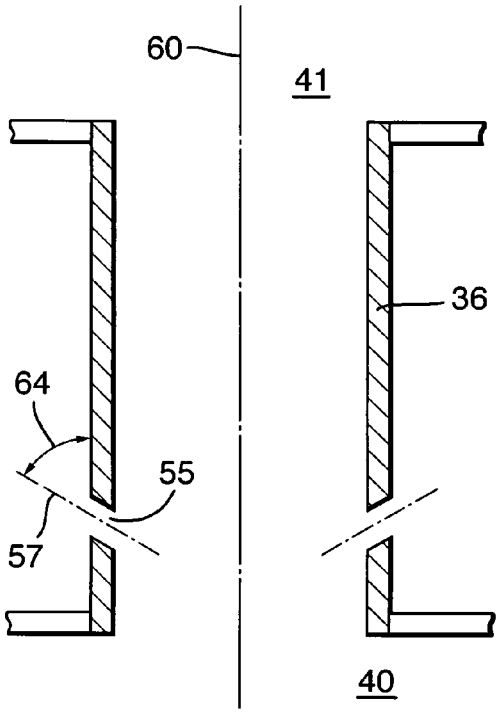
FIG. 4 is a cross section view of the resonator neck shown in FIG. 3 along the line IV-IV in the drawing of FIG. 3.

Referring now to FIGS. 3-6 which show various views of embodiments of the resonator neck 36 common to each of the resonators 38. As can be seen in FIG. 3, the tube has a circular cross section with a plurality of circumferentially spaced cooling holes 54 formed in the tube wall. The cooling holes 54 are equally spaced around the tube circumference and are inclined with respect to respective lines tangential to the tube circumference at the hole locations. As can be seen in the drawings of FIG. 4 a single row of holes is provided, positioned in the half of the neck 36 closest to the resonator cavity and about quarter of the way along the neck from the cavity, each of the holes 55 having an axis 57 angled towards the resonator cavity 40. The angle 64 formed between the hole axis and the axis 60 of the resonator neck 36 is of the order 30°. In use, the resonator is thus continually purged with cooling air passing through the array of holes 55. The purging air keeps the resonator cavity at a temperature at which no thermal damage occurs and beneficially creates a flow of air in the neck that travels from the cavity to the combustion chamber both cooling the neck and preventing ingestion of hot combustor gasses.

Figure 5:
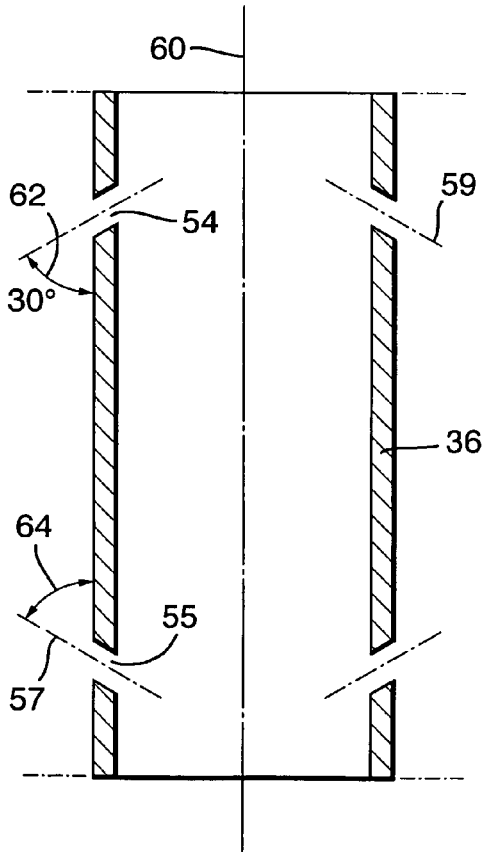
FIG. 5 is a cross section view of an alternative embodiment of a resonator neck similar to that in the drawing of FIG. 3.

In an alternative, and preferred embodiment, depicted in FIG. 5, a second row 54 of holes is provided in an axially spaced relation with the first row of holes 55, along the length of the neck.

The second row of holes 54 is positioned closer to the end of the neck that opens into the combustion chamber than the first row of holes 55. The second row of holes consists of twenty 0.5 mm diameter holes in a 16.0 mm diameter tube. The holes have an axis 59 that is angled with respect to the longitudinal axis of the neck and directed towards the combustor chamber.

As shown in FIG. 3, in the plane perpendicular to the longitudinal axis of the tube the holes 54 and 55 are angled so that they have both a radial and tangential component with respect to the circumference of the tube. Each hole is inclined at angle 45 degrees, as indicated by angle 56 in the drawing of FIG. 3, with respect to the radial line 58 through the respective hole and the tube longitudinal axis. This promotes vortex flow on the interior surface of the tube when cooling air passes from the exterior region of the tube into the interior region thereof.

The second row of holes 54 are inclined at an angle of about 15° to 20° with respect to respective lines tangential to the tube circumference at the hole locations. The inclination is less than that of the first row of holes 55 and consequently the swirl generated by the second row of holes is less than that generated by the first row of holes.

The reduced swirl component allows the flow of air to adhere to the inner wall of the resonator neck. The adherence improves the vortex shedding at the combustor opening and consequently the damping achieved by the resonator.

Figure 6:
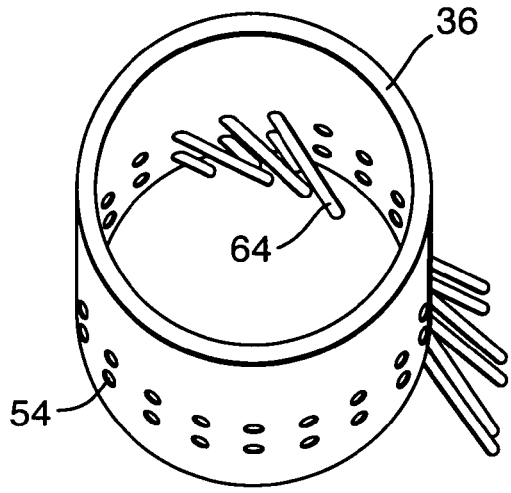
FIG. 6 is a perspective view of the resonator neck showing the beam paths of a laser in a process of laser drilling cooling holes in the tube wall.

The three dimensional nature of the inclination of the holes with respect to the wall of the tube is more clearly presented in FIG. 6 which shows the path of respective laser beams 64 passing through the holes and the open end of the tube during laser drilling of the holes. As the beams follow a substantially straight line the beams are indicative of the cooling hole axes.

The vortex induced by the holes directed towards the combustion chamber can suck hot combustion gasses from the combustion chamber deep into the resonator neck, and sometimes deep into the resonator cavity. In the present embodiments, the presence of a row of holes angled towards the resonator cavity induces a flow of air from the cavity along the resonator neck and inhibits the flow of hot combustion gas within the neck.

Figure 7:
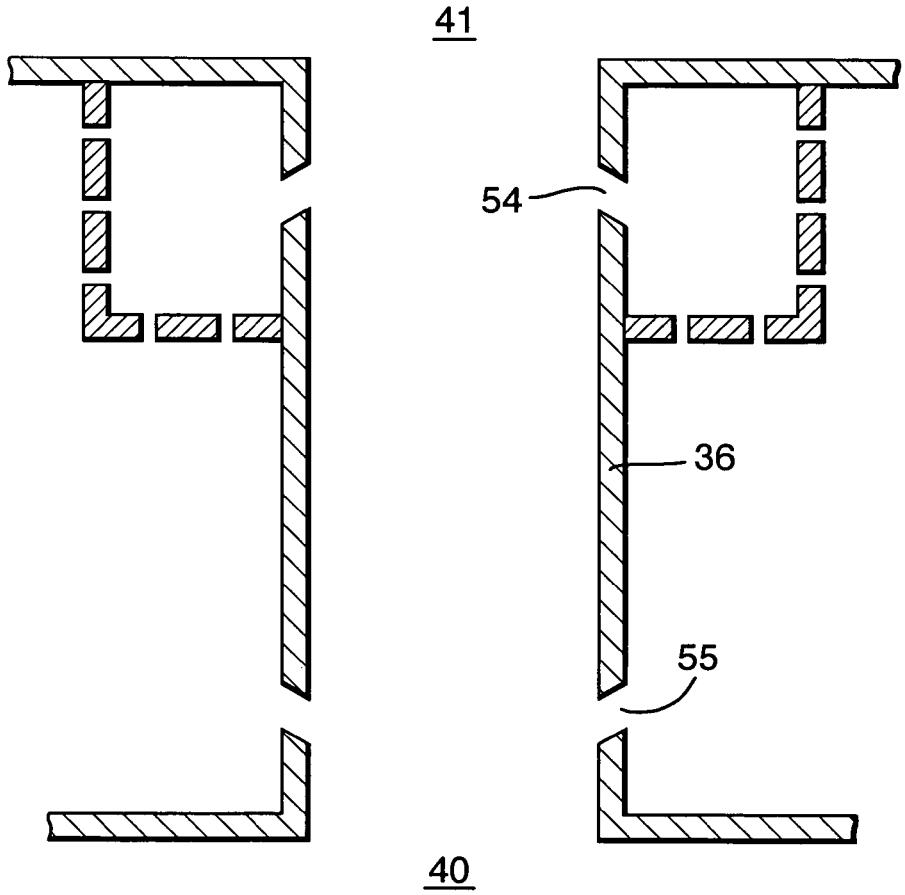
FIG. 7 depicts a resonator having improved damping performance.

The damping ability of the second row of holes 54, angled towards the combustion chamber, is further improved by metering the flow through these holes. A screen, as depicted in FIG. 7, is provided with a plurality of holes. The screen reduces the volume and velocity of the air through the second row of holes and the vortex shedding within the combustor chamber is therefore controlled depending on the porosity of the screen, the pressure drop across the screen and the arrangement and size of the holes in the tube, the optimum sizes and arrangements can be determined empirically.

Although aspects of the invention have been described with reference to the embodiments shown in the accompanying drawing, it is to be understood that the invention is not limited to those precise embodiments and that various changes and modifications may be effected without further inventive skill and effort. For example, other hole configurations may be used including arrangements where the holes are arranged in several rows, in line, or staggered with respect to each other, with different diameters, number of holes and angles depending on the specific cooling requirements of the particular combustion chamber application. In addition, different shaped holes may be employed instead of substantially circular cross section holes. The drawings of FIGS. 1 and 2 show the resonators positioned on the radially inner side of the combustion chamber and mounted to the combustion chamber inner casing. In other embodiments the resonators may be located on the radially outer side of the combustion chamber and secured to the combustion chamber outer casing 16. In the latter arrangement a windage shield would not necessarily be required.

We claim:

1. A combustion chamber for a gas turbine engine comprising at least one Helmholtz resonator having a resonator cavity and a resonator neck in flow communication with the interior of the combustion chamber, the neck having cooling holes extending through a wall thereof, at least one of the cooling holes having an axis that is directed towards the resonator cavity such that in use the cooling holes direct cooling air into the resonator cavity.

2. A combustion chamber according to claim 1, comprising at least two Helmholtz resonators.

3. A combustion chamber according to claim 1, wherein a plurality of cooling holes are provided in the wall of the neck.

4. A combustion chamber according to claim 1, wherein the cooling holes are circumferentially spaced in one or more rows extending around the circumference of the neck.

5. A combustion chamber according to claim 4, wherein at least two circumferential rows are provided and the rows are axially spaced.

6. A combustion chamber as claimed in claim 5 wherein the holes of a circumferential row towards the combustion chamber end of the neck are angled in a direction towards the combustion chamber end of the neck such that the respective axes of the holes converge in the direction of the combustion chamber.

7. A combustion chamber as claimed in claim 6, wherein the angle of the holes with respect to the longitudinal axis of the neck is substantially in the range of 15 to 40 degrees.

8. A combustion chamber as claimed in claim 7 where the said angle is substantially 30 degrees.

9. A combustion chamber according to claim 6, wherein the holes of a circumferential row towards the combustion chamber end of the neck is enclosed by a perforated screen for metering the air passing through the holes.

10. A combustion chamber as claimed in claim 1, wherein the neck is tubular and said holes are angled with respect to the neck circumference.

11. A combustion chamber as claimed in claim 10 wherein the holes have a tangential component substantially in the range of 30 to 60 degrees with respect to the neck circumference.

12. A combustion chamber as claimed in claim 11 wherein the angle of the holes with respect to the neck circumference is substantially 45 degrees.

13. A Helmholtz resonator for a gas turbine engine combustion chamber; the said resonator having a resonator cavity and a resonator neck for flow communication with the interior of the combustion chamber, the neck having cooling holes extending through a wall thereof, at least one of the cooling holes having an axis that is directed towards the resonator cavity such that in use the cooling holes direct cooling air into the resonator cavity.

* * * * *